US007225602B2

(12) United States Patent
Dubourg

(10) Patent No.: US 7,225,602 B2
(45) Date of Patent: Jun. 5, 2007

(54) STIRRUP WITH AUTOMATIC FIXING

(76) Inventor: Yann Dubourg, Chateau Perron, 33210 Roaillan (FR)

( * ) Notice: Subject to any disclaimer, the term of this patent is extended or adjusted under 35 U.S.C. 154(b) by 123 days.

(21) Appl. No.: 10/504,953

(22) PCT Filed: Feb. 24, 2003

(86) PCT No.: PCT/FR03/00604

§ 371 (c)(1),
(2), (4) Date: May 4, 2005

(87) PCT Pub. No.: WO03/070622

PCT Pub. Date: Aug. 28, 2003

(65) Prior Publication Data

US 2005/0229552 A1 Oct. 20, 2005

(30) Foreign Application Priority Data

Feb. 22, 2002 (FR) ..... 02 02311

(51) Int. Cl.
*B68C 3/00* (2006.01)

(52) U.S. Cl. ..... 54/49

(58) Field of Classification Search ..... 54/49, 54/47; 280/1.207, 1.183
See application file for complete search history.

(56) References Cited

U.S. PATENT DOCUMENTS 215,942 A 5/1879 De La Nux
459,291 A * 9/1891 Johnson et al. ..... 54/49
722,877 A 3/1903 Nikolaisen
1,622,510 A * 3/1927 Hendriks ..... 54/49
2005/0060967 A1* 3/2005 Sjosward ..... 54/49

FOREIGN PATENT DOCUMENTS

DE 62244 5/1892

* cited by examiner

*Primary Examiner*—Teri Pham Luu
*Assistant Examiner*—Elizabeth Shaw
(74) *Attorney, Agent, or Firm*—Patterson, Thuente, Skaar & Christensen, P.A.

(57) ABSTRACT

The invention concerns a device designed to be used in horse riding, consisting of a pivoting base provided with female fixing means so as to be secured to the rider's foot through a male fixing means attached on the sole of his shoes. The use of a single stirrup branch enables rapid release of the foot outwards. Said branch includes damping means so as to absorb part of the forces exerted on the stirrup by the rider's weight and thus avoid accidental release of the attachment. The automatic stirrup provides greater safety in case the rider falls by preventing the foot from being jammed through the use of a single branch prevents the rider from losing his stirrups as a result of the horse's sudden movements or loss of balance through the fixing means and dampens the rider's movements, particularly when jumping over an obstacle through its damper.

8 Claims, 2 Drawing Sheets

STIRRUP WITH AUTOMATIC FIXING

RELATED APPLICATION

This application claims priority to PCT Application No. PCT/FR2003/00604 filed Feb 24, 2003, and French Application No. 0202311 filed Feb. 22, 2002.

FIELD OF THE INVENTION

This invention relates to a stirrup with an automatic binding, designed to facilitate horseback riding and make it safe by securing the rider's foot in the stirrup using two associated retaining mechanisms that mate with elastic return force to allow the binding to engage and disengage.

BACKGROUND OF THE INVENTION

Traditionally, a horseback riding stirrup is composed of a loop, two branches, and a bottom.

The use of two branches allows the rider to more easily remain in the stirrups, since the foot is only able to exit through a rearward motion, and it is not possible to lose the stirrup through a lateral movement. The drawback of using two branches is the danger of a foot becoming blocked in the stirrup if it is inserted too far. The use of a heeled boot arises from the need to protect the rider from that risk of becoming blocked. It is effective without being perfect or helping the rider to remain in the stirrups in all situations.

SUMMARY OF THE INVENTION

The device according to the invention is a stirrup with a single branch whose bottom, affixed to a pin through the intermediary of a hub, is able to rotate forward and rearward. The bottom comprises a female binding mechanism. This binding mechanism is composed of two bars parallel to the axis of rotation. These bars may be separated parallel to the pin and are maintained in position by elastic return forces.

The ends of the bars, wound in spirals around two pins integral with the bottom, constitute the elastic return forces.

The female binding mechanism is designed to mate with a male binding mechanism affixed to the sole of the rider's shoe. The rider engages the automatic binding by inserting the male binding mechanism on his shoe between the two bars of the female binding when, once in the saddle, he puts his feet in the stirrups.

Once engaged, the automatic binding eliminates all risk of inadvertently losing the stirrups. Regardless of the rider's leg movements or movements by the horse, the rider remains in the stirrups, which provides better balance for beginning riders and better control of the horse for experienced riders.

The pin, which is integral with the branch of the stirrup, comprises a projection topped with a stop that disengages by means a hub with a hollow center.

This projection attached to the disengagement stop prevents the bottom from completely rotating around the pin. When the bottom rotates forward or rearward beyond a predefined angle, the disengagement stop of the pin exerts pressure on the bars of the female binding of the bottom. This pressure is an antagonistic force to the elastic return force, which disengages the male binding from the shoe. This disengagement mechanism makes it possible to remove the stirrups and ensures the safety of the rider in the event of a fall. This disengagement may be adjustable according to the weight of the rider.

An adjustment mechanism on the male binding on the sole of the shoe allows the rider to adjust the binding point from the front to the rear of the sole. This adjustment mechanism makes it possible to exert pressure on the stirrup at the location on his foot that suits him perfectly.

The lower part of the single branch of the automatic stirrup contains a shock absorber. This shock absorber absorbs the variations in pressure exerted on the stirrup and, therefore, absorbs any untimely forces exerted on the disengagement mechanism of the binding. This shock absorber provides greater comfort to both rider and horse, and is particularly useful when jumping.

BRIEF DESCRIPTION OF THE DRAWINGS

The embodiment, provided as a non-limiting example, refers to the attached figures.

DETAILED DESCRIPTION OF THE INVENTION

Figure 1:
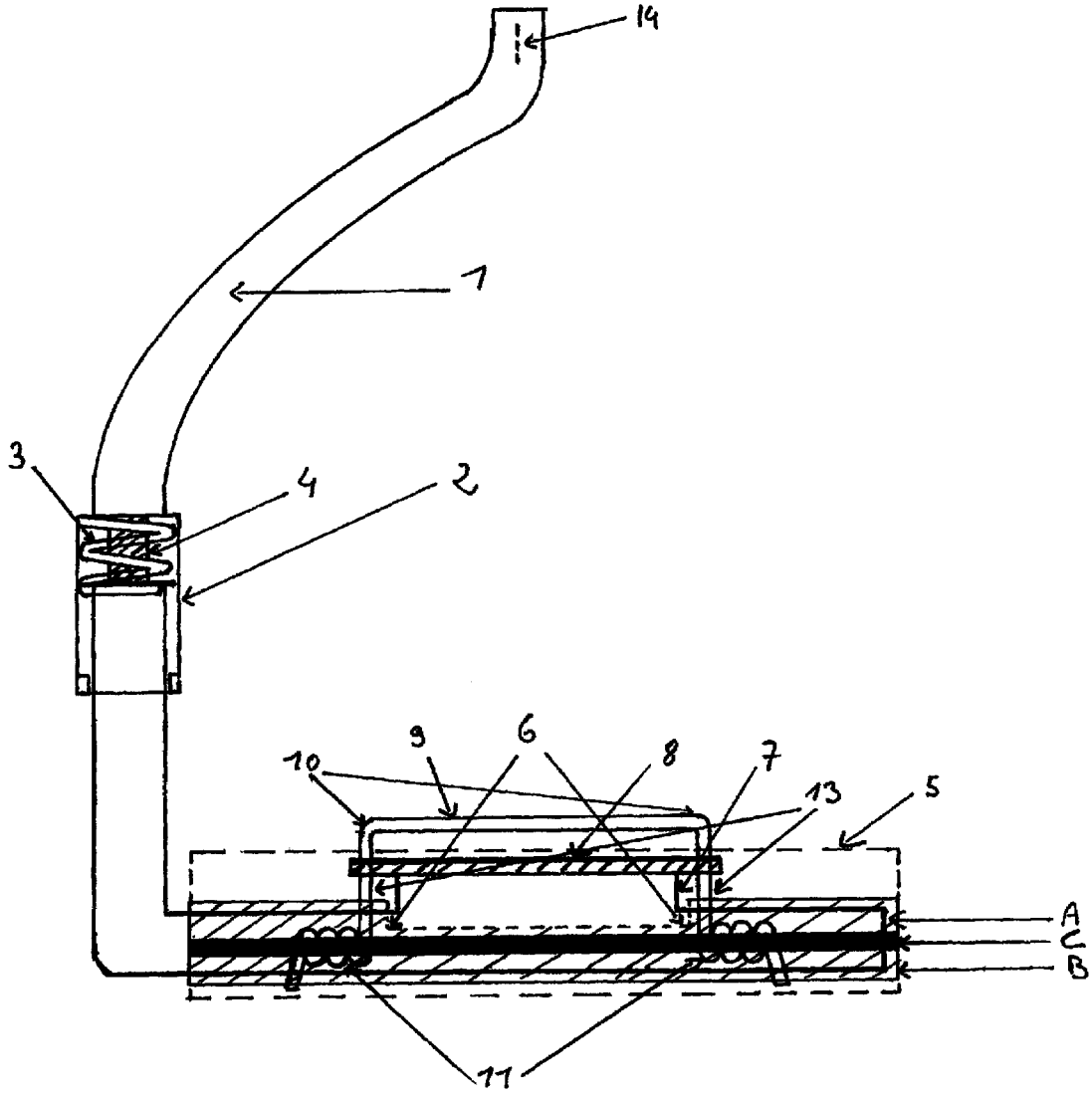
FIG. 1 is a front schematic view of the stirrup according to the invention.
Figure 2:
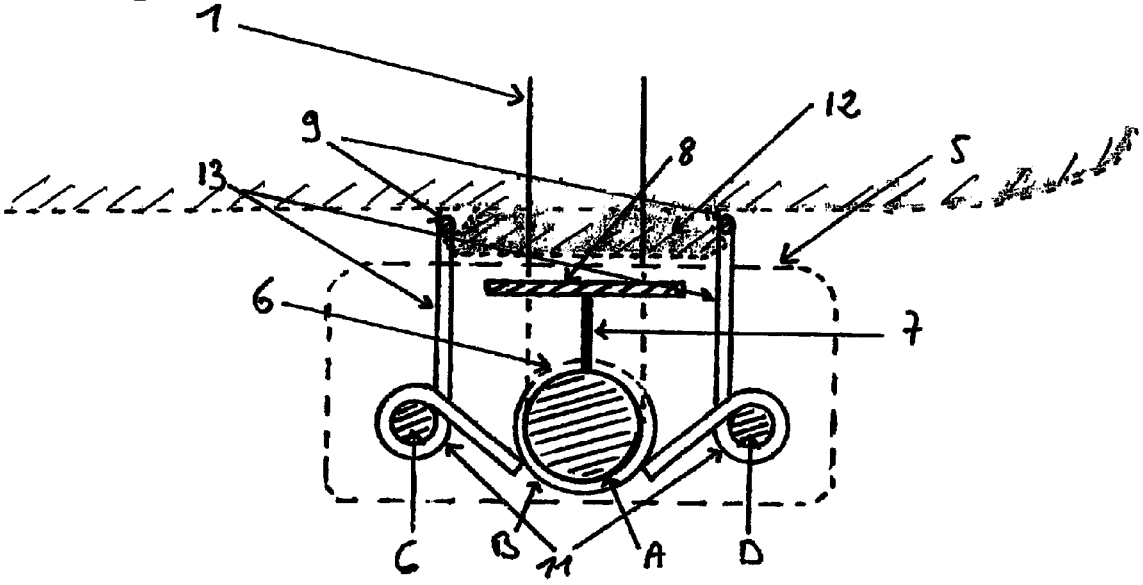
FIG. 2 is a longitudinal schematic cross-section of the bottom of the stirrup according to the invention.

Above the fixation of the bottom, the branch 1 of the stirrup, made of aluminum, may comprise a shock absorber system 2 composed of a spring 3 and an elastomer 4.

A steel pin A is affixed perpendicularly to the branch 1 at its base.

A bottom 5, made of a composite material, is rotationally affixed to the pin A through the intermediary of a steel hub B.

A hollow 6 in the center of the hub B allows a projection 7 to be affixed to the pin A.

This projection 7 on the pin A is topped with a flat rectangular piece 8 that plays the role of a disengagement stop.

The hollow 6 in the hub B allows the bottom to pivot around the pin A, despite the projection, within the limits of the hollow.

Two pins C and D are affixed to the right and left walls of the bottom 5 parallel to the pin A on each side of the hub B.

Two steel wires each for an inverted U in a vertical plane from pins C and D. The U is obtained by piercing holes in the bottom 5, allowing the steel wire and two elbows 10 to pass through it. These inverted U shapes form two bars 9 above the bottom 5, parallel to the pin A, in front and behind it. These two bars 9 play the role of the female binding mechanism for the male binding mechanism 12 on the shoe.

The ends of these U-shaped steel wires are wound in a spiral around pins C and D, creating torsion springs 11

The torsion springs 11 of each steel wire allow the bars 9 to be separated when the male binding mechanism 12 of the shoe is being engaged, while exerting return force that returns the two bars 9 to their initial positions once the male binding mechanism 12 is in the engaged position.

The purpose of the part 8 mounted on the projection of the pin A is to disengage the male binding mechanism 12 of the shoe when the bottom pivots forward or rearward.

Integral with the bottom mounted rotationally on the pin A via the two pins C and D, the two vertical branches 13 of each U-shaped steel wire abut against the part 8 when the bottom rotates.

The pressure exerted by the part 8 on the vertical branches 13 allows the bars 9 to be separated in order disengage the male binding mechanism of the shoe. When the bottom 5 rotates forward, the branches 13 of the steel wire placed behind the pin A abut against the rear part of the part 8 and cause the rear bar 9 to separate rearward. This separation releases the male binding mechanism 12 of the rider's shoe. The effect is inversely identical for rearward rotation.

The width of the part 8 and the force of the torsion springs 11 determine the front and rear disengagement thresholds.

Loop 14 of branch 1 is created in an extension of the stirrup leather, such that the stirrup remains naturally perpendicular to the direction of the horse when it is at rest.

Using the automatic stirrup allows the rider to remain in his stirrups in all circumstances. Useful during abrupt, uncontrolled movements, the automatic stirrup allows the rider to retain his balance. This is a comfort and safety feature for the experienced rider as well as for the beginning rider.

The automatic stirrup is also particularly effective when the rider is riding seated in the saddle.

In effect, when he is seated in the saddle, the rider has to exert effort to maintain sufficient pressure not to lose his stirrups. The binding allows him to ride in a much more relaxed sitting position and his support is always available, adjusted exactly as he desires, using the adjustment mechanism on the male binding of the shoe.

The binding prevents the foot from having to constantly find the ideal pressure point that he is used to, and the leg is more steady.

The use of a single branch, attached to lateral break-away mechanism, provides maximum stirrup use safety. The foot can no longer become blocked in the stirrup in the event of a fall.

The suspension integrated into the branch of the stirrup absorbs shock, relieving the rider's knees, which usually play this shock absorber role, and the back of the horse.

The invention claimed is:

1. A stirrup for horseback riding to help a rider with balance and safety, comprising:

a single stirrup branch coupling a base to a stirrup leather; and a first retaining mechanism on the base adapted to exert an elastic return force to selectively engage a second retaining mechanism selectively on a shoe of a rider, wherein the first retaining mechanism and the second retaining mechanism operably disengage by a release mechanism disengaged by antagonistic forces sensitive to forward or rearward pressure exerted on the base.

2. A stirrup according to claim 1, wherein the base is rotatably mounted on a pin, wherein the first retaining mechanism comprises a female binding mechanism adapted to receive the second retaining mechanism, wherein the second retaining mechanism comprises a male binding mechanism coupled to the sole of the shoe, and wherein the female binding mechanism and the male binding mechanism operably disengage when the base rotates forward or rearward.

3. A stirrup according to claim 2, wherein the female binding mechanism comprises a pair of U-shaped bars mounted parallel to the pin of the base when elastic return forces are exerted between the bars by the male binding mechanism of the shoe at the time of engagement, or when pressure is exerted on the bars when disengaged by a rotational movement of the base.

4. A stirrup according to claim 3, wherein the elastic return forces are exerted by an end of each of the bars wound about one of two secondary pins to form a torsion spring.

5. A stirrup according to claim 4, wherein the secondary pins are integral with the base.

6. A stirrup according to claim 3, wherein a hub to which the base is affixed is hollow and is adapted to receive the pin, and wherein the pin comprises a projection portion.

7. A stirrup according to claim 6, wherein the projection portion of the pin on which the base of the stirrup is rotatably mounted on is coupled to a disengagement stop adapted to exert pressure on the U-shaped bars when pressure is exerted on the base to pivot the base forward or rearward.

8. A stirrup according to claim 7, wherein a shock absorber is integrated into the branch of the stirrup to limit untimely disengagement.

* * * * *